US006431883B2

(12) United States Patent
Pan

(10) Patent No.: US 6,431,883 B2
(45) Date of Patent: Aug. 13, 2002

(54) INPUT/OUTPUT CONNECTOR FOR A MOBILE ELECTRIC DEVICE

(75) Inventor: Long-Jyh Pan, Taipei Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/758,590

(22) Filed: Jan. 10, 2001

Related U.S. Application Data

(62) Division of application No. 09/427,110, filed on Oct. 26, 1999.

(30) Foreign Application Priority Data

Nov. 16, 1998 (TW) ..... 87218951 U

(51) Int. Cl.[7] ..... H01R 12/00

(52) U.S. Cl. ..... 439/79; 439/603; 439/629; 439/733.1; 439/746

(58) Field of Search ..... 439/79, 637, 603, 439/629, 733.1, 746

(56) References Cited

U.S. PATENT DOCUMENTS 3,289,148 A 11/1966 Antes
4,659,158 A * 4/1987 Sakamoto et al. ..... 439/603
5,024,609 A * 6/1991 Piorunneck ..... 439/637

* cited by examiner

*Primary Examiner*—Tho D. Ta
*Assistant Examiner*—Truc Nguyen
(74) *Attorney, Agent, or Firm*—Ladas & Parry

(57) ABSTRACT

An input/output connector adapted for a mobile electric device. The input/output connector includes a connector body and at least one pair of terminals. The connector body is exposed to the outside and having at least one pair of terminal holes. Each terminal hole is provided with an engaging block at a position adjacent to the outside respectively. A contact portion is formed at one end of the terminal, and an engaging portion is formed at the other end. Each engaging portion engages with the engaging block, and the opposing contact portions hold a printed circuit board of the mobile electric device. Therefore, the printed circuit board is capable of electrically communicating with the external electric device.

7 Claims, 9 Drawing Sheets

INPUT/OUTPUT CONNECTOR FOR A MOBILE ELECTRIC DEVICE

This application is a division of U.S. appl. Ser. No. 09/427,110, filed Oct. 26, 1999.

BACKGROUND OF THE INVENTION

1. Field of the Invention

The present invention relates to an input/output connector, particularly to an input/output connector adapted for a mobile electric device, such as a mobile phone.

2. Description of Prior Art

An input/output connector disposed inside a mobile electric device can communicate with an external electric device. Conventionally, terminals of the input/output connector are directly welded onto the printed circuit board. Accordingly, when a plug is inserted into the input/output connector or an inserted plug is pulled out from the input/output connector, the terminals of the input/output connector are easily damaged due to a friction between the plug and the input/output connector.

FIG. 1 shows a conventional mobile phone, in which reference numeral 1 represents an upper shell of the mobile phone, reference numeral 2 represents a lower shell that detachably engages with the upper shell 1, and reference numeral 3 represents a printed circuit board disposed in the lower shell 2. An input/output connector 4 is usually mounted at the bottom of the lower shell 2 and electrically connected to the printed circuit board 3.

FIG. 2*a* and FIG. 2*b* show the details of the input/output connector 4. Being different from the previous welding manner, the input/output connector 4 holds the printed circuit board. The input/output connector 4 consists mainly of a body portion 5 and a plurality of terminals 6. The body portion 5 is provided with a plurality of terminal holes 51 for receiving the terminals 6. The body portion 5 is provided with a plurality of bulges 52 on its periphery. Each bulge 52 can abut against the lower shell 2 of the mobile phone so that the input/output connector is fixed inside the mobile phone. Each terminal 6 is provided with a contact portion 61 and a positioning portion 62 respectively, wherein each contact portion 61 is substantially "Λ" in shape so as to abut against the body portion 5 before the printed circuit board 3 is inserted into the input/output connector. After the printed circuit board 3 is inserted into the input/output connector, the contact portions 61 of the terminals 6 are in contact with the printed circuit board 3. Furthermore, each positioning portion 62 of the terminal 6 abuts against a positioning block 53 of the body portion 5, respectively. Each positioning portion 62 is made of metal and thus can electrically communicate with an external electric device.

The defect of the input/output connector as shown in FIGS. 2*a*–2*c* is that the terminals 6 are easily moved. Since each terminal 6 is disposed in the body portion 5 by the spring force of the contact portion 61 of the terminal 6 itself, the terminal 6 is easily moved or pushed out of the body portion 5 when the printed circuit board 3 is inserted into the input/output connector, as shown in FIG. 2*c*. As a result, the quality of the input/output connector is unstable. Furthermore, the terminals 6 disposed in the body portion 5 are arranged in a single array, thus the input/output connector occupies a large space in the mobile phone.

SUMMARY OF THE INVENTION

The object of the present invention is to solve the above-mentioned problems and provide an input/output connector adapted for a mobile electric device, for example a mobile phone. The input/output connector comprises a connector body and at least one pair of terminals, wherein the connector body is exposed to the outside of the shell and provided with at least one pair of terminal holes, and an engaging block is located inside each terminal hole at a position adjacent to the outside. Furthermore, a contact portion is formed at one end of each terminal and an engaging portion is formed at the other end. Each engaging portion respectively engages with the engaging block and the contact portions of each pair of the terminals hold the printed circuit board of the mobile electric device. Any portion of each contact portion exposed to the outside of the shell can communicate with an external electrical device.

BRIEF DESCRIPTION OF THE DRAWINGS

The objects, features and advantages of the present invention can be more fully understood by reading the subsequent detailed description and examples with reference made to the accompanying drawings, wherein.

DETAILED DESCRIPTION OF THE PREFERRED EMBODIMENT

Figure 1:
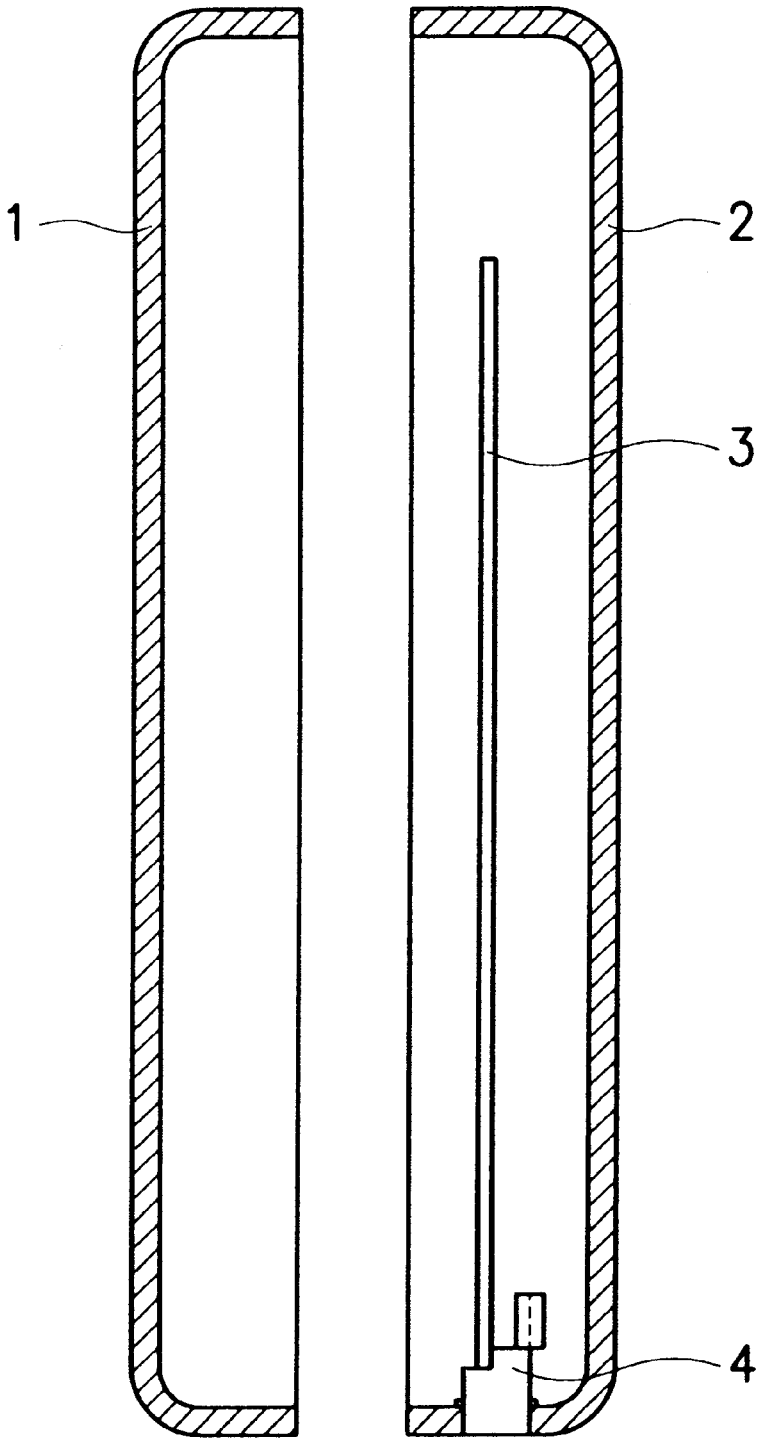
FIG. 1 (PRIOR ART)
FIG. 1 is a schematic diagram of a mobile phone.
Figure 2A:
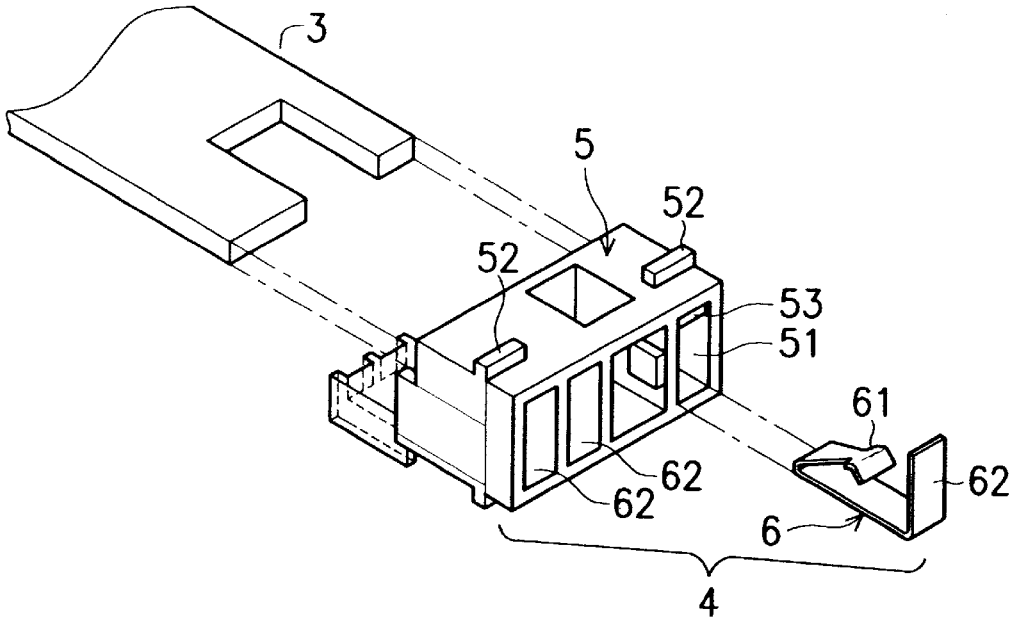
FIG. 2a (PRIOR ART)
FIG. 2*a* is a three-dimensional diagram of a conventional input/output connector, wherein one terminal is not inserted into the body portion.
Figure 2B:
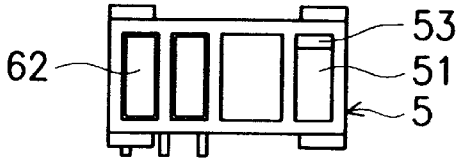
FIG. 2b (PRIOR ART)
FIG. 2*b* is a plane diagram of the conventional input/output connector.
Figure 2C:
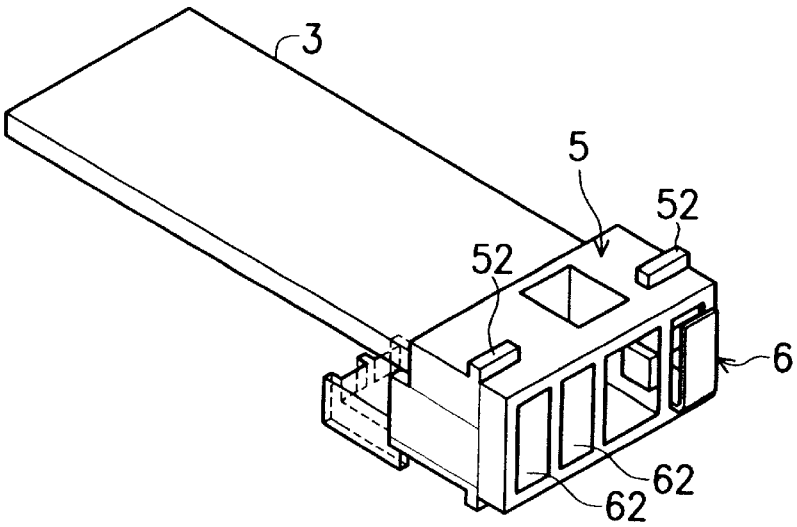
FIG. 2c (PRIOR ART)
FIG. 2*c* is a three-dimensional diagram of the conventional input/output connector, wherein one terminal is pushed out of the body portion by a printed circuit board.
Figure 3E:
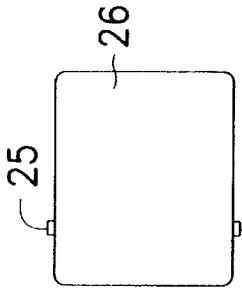
FIG. 3*e* is a side view of the connector body of the present invention.
Figure 3C:
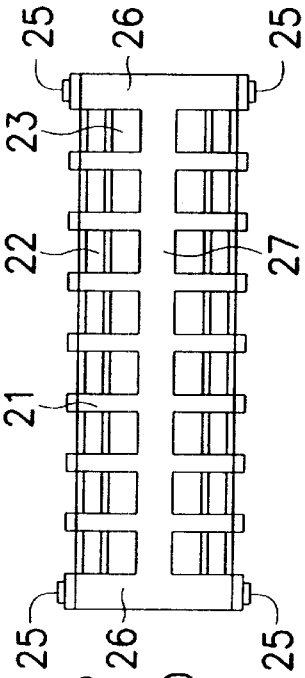
FIG. 3*c* is a plane view of the connector body of the present invention.
Figure 3D:
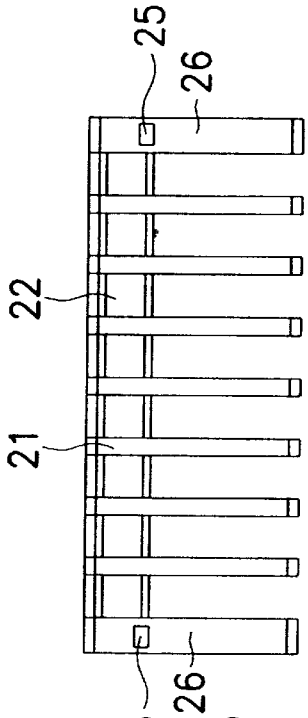
FIG. 3*d* is a plane view of the connector body of the present invention.
Figure 3A:
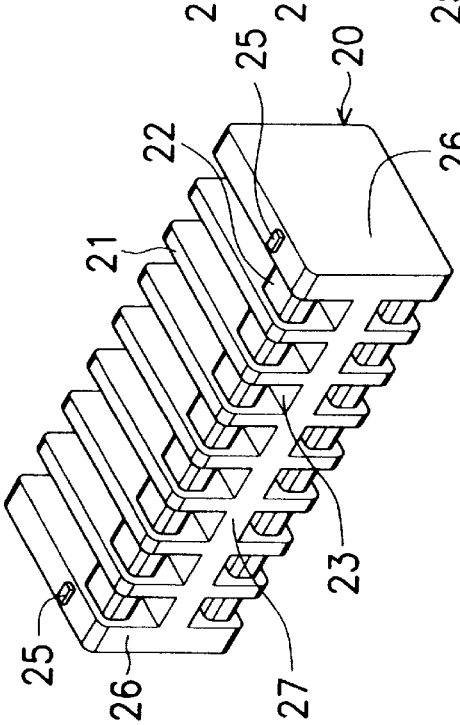
FIG. 3*a* is a three-dimensional diagram of a connector body of the present invention.
Figure 3B:
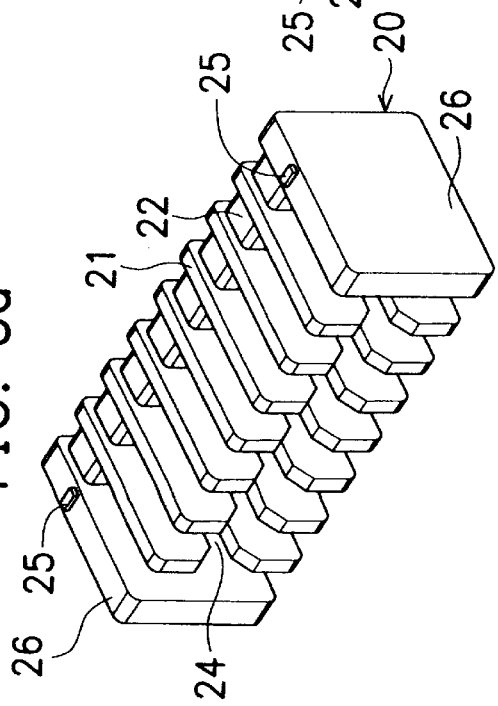
FIG. 3*b* is a three-dimensional diagram of the connector body of the present invention in a different view.

An input/output connector of the present invention is described below referring to FIGS. 3*a*–3*e,* 4, 5*a*–5*e* and 6*a*–6*f.*

An input/output connector according to one embodiment of the present invention comprises a connector body and a plurality of terminals. FIGS. 3*a*–3*e* show the connector body 20 of the present invention. The connector body 20 is further provided with a plurality of partitions 21, a plurality of engaging blocks 22, a plurality of terminal holes 23, two plates 26 and a shaft 27 connecting the plates 26. Each partition 21 is connected with the shaft 27 and separated from each other by a distance. Each engaging block 22 is substantially rectangular in shape and arranged between the partitions 21 or between the plate 26 and the partition 21. Furthermore, each terminal hole 23 is formed between the engaging block 22 and the shaft 27 so as to receive a terminal, which will be described afterward.

Figure 4:
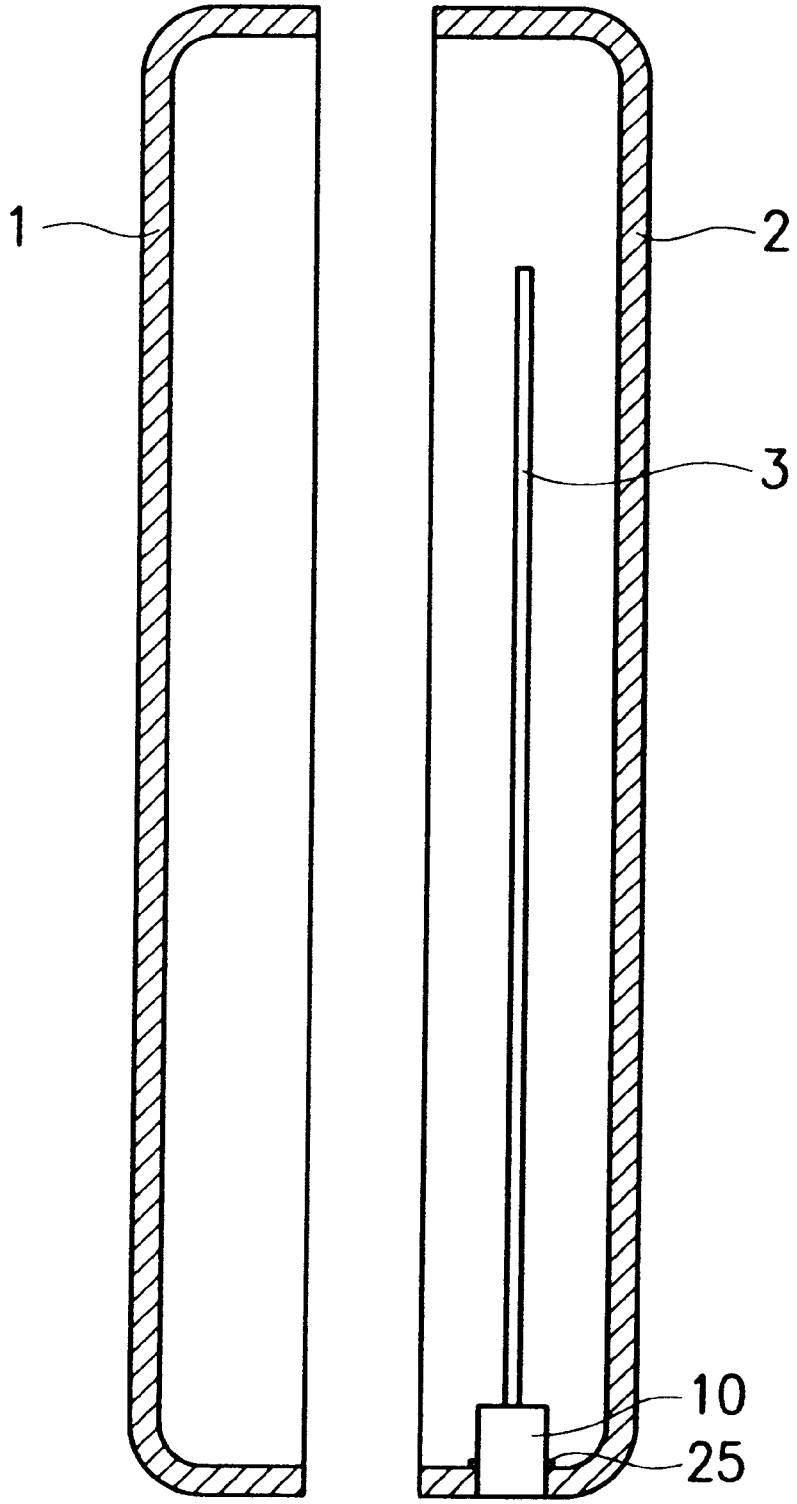
FIG. 4 is a schematic view showing the input/output connector of the present invention mounted on the mobile phone.

The connector body 20 is also provided with a slot 24. A printed circuit board of a mobile phone can be inserted into the slot 24. The connector body 20 is also provided with at least one bulge 25 on its peripheral so that the input/output connector can be disposed inside the mobile phone, as shown in FIG. 4.

Figure 5A:
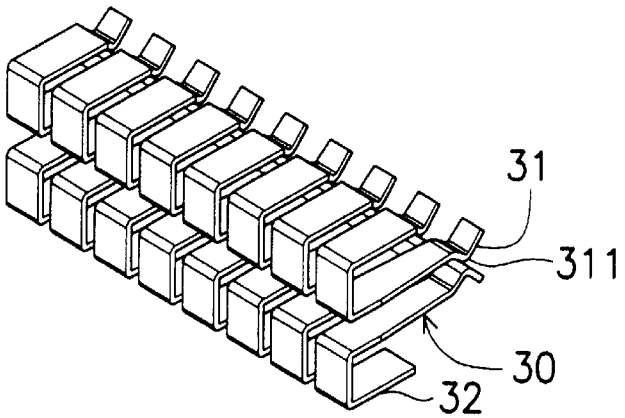
FIG. 5*a* is a three-dimensional diagram of terminals of the present invention, wherein the terminals are not bent.
Figure 5B:
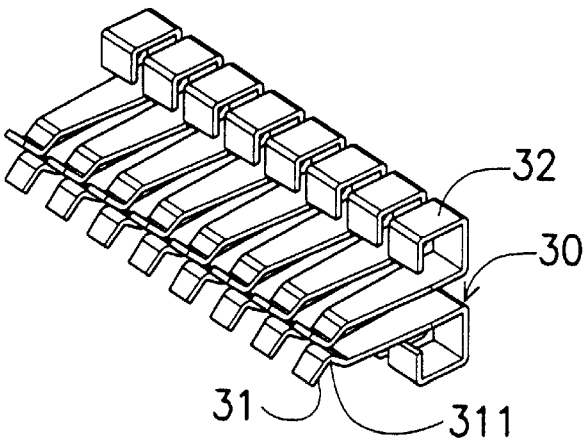
FIG. 5*b* is a three-dimensional diagram of the terminals of the present invention in a different view, wherein the terminals are bent.
Figure 5C:
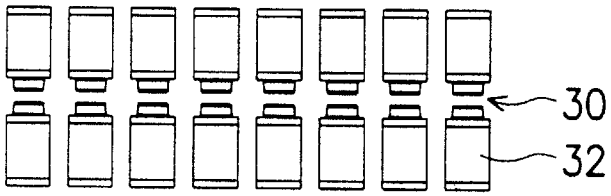
FIG. 5*c* is a plane view of the terminals of the present invention.
Figure 5D:
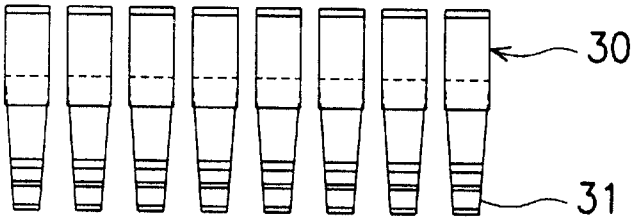
FIG. 5*d* is a plane view of the terminals of the present invention.
Figure 5E:
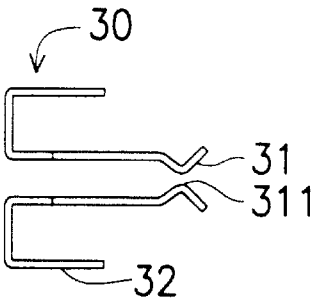
FIG. 5*e* is a side view of the terminals of the present invention.

FIGS. 5*a*–5*e* show the terminals of the present invention. Each terminal 30 is provided with a contact portion 31 and an engaging portion 32. A front end of each contact portions 31 is bent into a convex portion 311 respectively. The convex portions 311 are substantially ">" and "<" in shape so as to hold the printed circuit board firmly. Before being fixedly disposed on the connector body 20, the engaging portions 32 are shown in FIG. 5*a*. When the terminals 30 are fixedly disposed on the connector body 20 through the terminal holes 23, the engaging portions 32 are bent by a tool into the shape shown in FIG. 5*b*. Accordingly, the engaging portions 32 of the terminals 30 surround the engaging blocks 22 of the connector body 20 so that the terminals 30 can be fixedly disposed on the connector body 20.

Figure 6B:
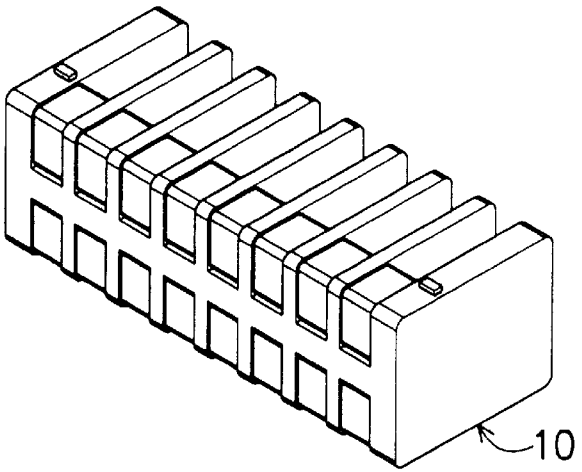
FIG. 6*b* is a three-dimensional diagram of the input/output connector of the present invention
Figure 6A:
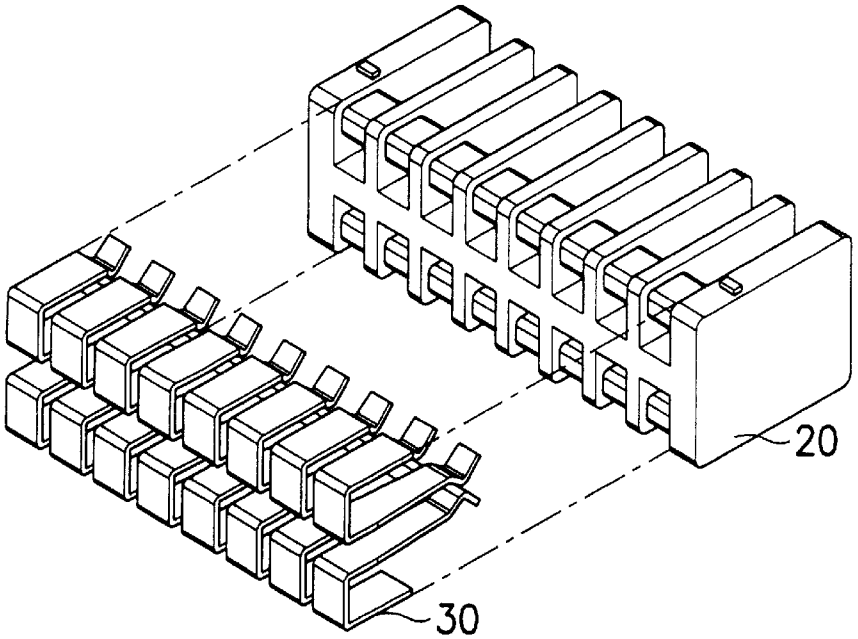
FIG. 6*a* is an exploded view of the input/output connector of the present invention.
Figure 6F:
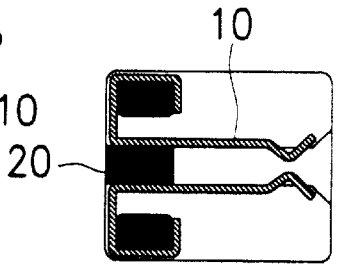
FIG. 6*f* is a sectional diagram along a line A—A in FIG. 6*e;*
Figure 6E:
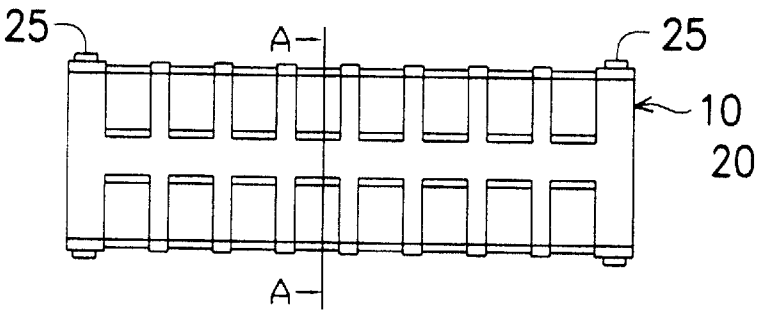
FIG. 6*e* is a plane view of the input/output connector of the present invention.
Figure 6D:
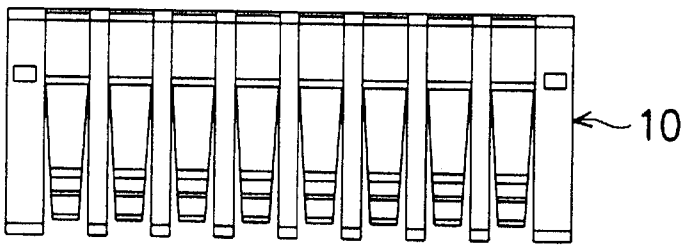
FIG. 6*d* is a plane view of the input/output connector of the present invention.
Figure 6C:
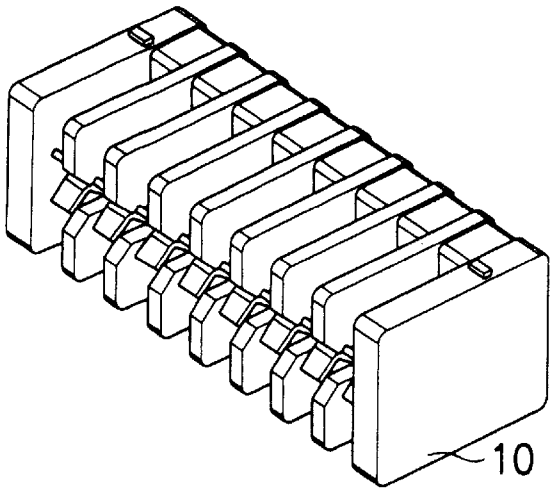
FIG. 6*c* is a three-dimensional diagram of the input/output connector of the present invention in a different view.

FIGS. 6*a*–6*f* show an input/output connector of the present invention. FIG. 6*a* shows an input/output connector in which the terminals 30 are not disposed on the connector body 20 and the engaging portions 32 of the terminals 30 are not bent. FIGS. 6*b*–6*f* are respectively a perspective view, plan views and a sectional view of the input/output connector of the present invention, wherein the engaging portions 32 of the terminals 30 are bent, and each engaging portion 32 surrounds the outer surface of the engaging block 22 of the connector body 20.

Figure 7A:
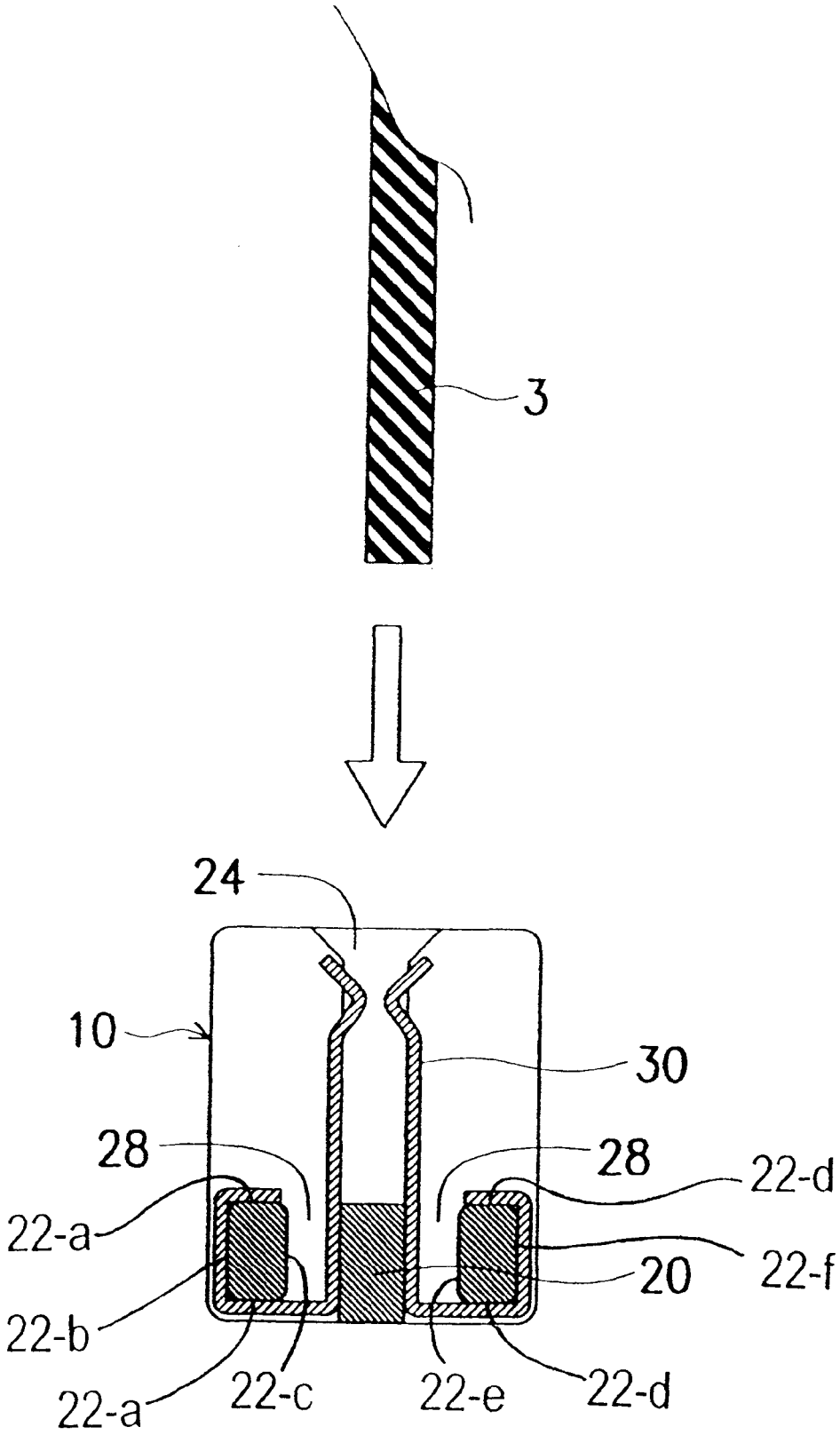
FIG. 7*a* is a schematic diagram showing the connection between the input/output connector of the present invention and the printed circuit board before the connection is completed.
Figure 7B:
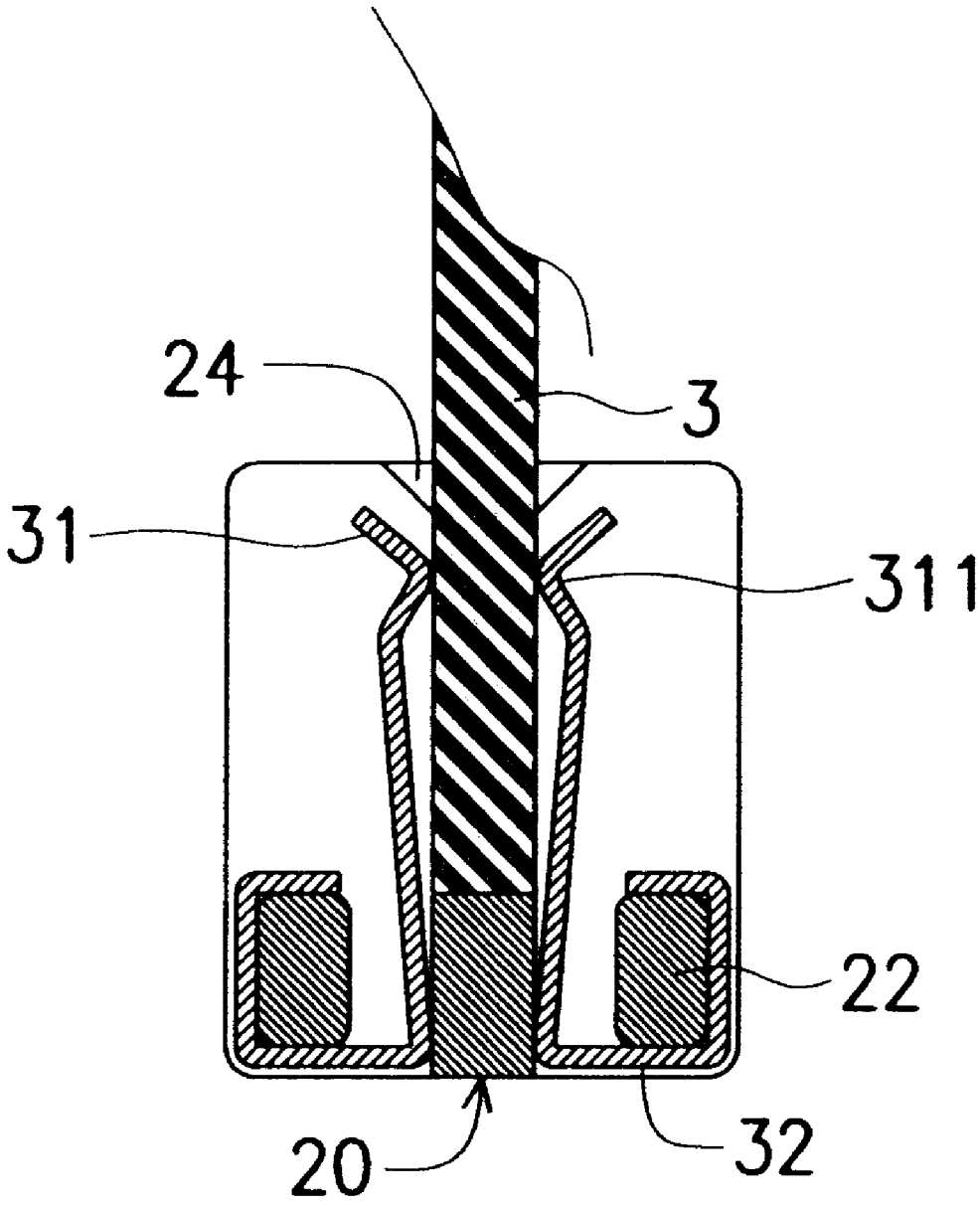
FIG. 7*b* is a schematic diagram showing the connection between the input/output connector of the present invention and the printed circuit board after the connection is completed.

FIGS. 7*a*–7*b* are schematic diagrams showing the connection between the input/output connector of the present invention and the printed circuit board 3. When the printed circuit board 3 engages with the input/output connector 10, one end of the printed circuit board 3 abuts against the connector body 20, and the contact portions 31 of the terminals 30 hold the printed circuit board 3 and the terminals 30 are thus electrically connected with the circuits on the printed circuit board 3. FIG. 7*a* also shows the individual sides of engaging block 22 as having, first opposing sidewalls 22-*a,* second opposing sidewalls 22-*d,* first top surface 22-*b,* second top surface 22-*e,* first bottom surface 22-*c,* and second bottom surface 22-*f.* In addition a space 28 is formed between first terminal 30 and the first bottom surface 22-*c* such that neither the first contact portion nor the first engaging portion come in contact with the first bottom surface, so that the first terminal can bend upwardly for a predetermined distance without engaging with the first bottom surface 22-*c.* Likewise a space 28 is formed between first terminal 30 and the second top surface 22-*e* such that neither the first contact portion nor the first engaging portion come in contact with the second top surface, so that the terminals can bend upwardly for a predetermined distance without engaging with the second top surface 22-*e.*

Referring to FIG. 4 and FIG. 7*b,* the input/output connector 10 is disposed inside the lower shell 2 of the mobile phone by means of the bulges 25 of the connector body 20. Any portion of each engaging portion 32 exposed to the outside can electrically communicate with the external electric device. The input/output connector 10 holds the printed circuit board 3 by means of the slot 24 of the connector body 20 and the contact portions 31 of the terminals 30.

In this embodiment, the terminals are made of metal. However, it should be noted that the terminals could also be made of other conductive materials capable of carrying electric signals.

The following are the advantages of the present invention:

(1) The input/output connector of the present invention occupies fewer space in a mobile electric device. The terminals of the present invention are arranged in two rows, while the terminals of the conventional input/output connector are arranged in one row. Thus, the input/output connector of the present invention can leave more space for other devices in the mobile electric device.

(2) Because the terminals are not welded to the printed circuit board, the insertion and the extraction of the plug will not damage the welding points on the printed circuit board.

(3) Since each terminal surrounds the engaging block of the connector body, the terminals are tightly connected to the connector body and will not be pushed out of the connector body easily.

Although this invention has been described in its preferred embodiments, it is understood that the present disclosure of the preferred embodiments can be modified in the details of contraction. The scope of the invention should be determined by the appended claims and not by the specific examples given herein.

What is claimed is:

1. An input/output connector comprising:

a connector body having a first terminal hole and a second terminal hole;

a first engaging block disposed within the first terminal hole, the first engaging block having a first bottom surface, two opposing first sidewalls, and a first top surface;

a second engaging block disposed within the second terminal hole, the second engaging block having a second bottom surface, two opposing second sidewalls, and a second top surface;

a first terminal having a first contact portion and a first engaging portion, the first contact portion being disposed below the first bottom surface, the first engaging portion engaging with the two opposing first sidewalls; and a second terminal having a second contact portion and a second engaging portion, the second contact portion being disposed above the second top surface, the second engaging portion engaging with the two opposing second sidewalls;

wherein the first and second contact portions of the terminals are capable of holding a printed circuit board, and the first and the second engaging portions engage with the two opposing first and second sidewalls respectively to inhibit removal of the terminals from said connector body in a direction away from and toward said printed circuit board.

2. An input/output connector as claimed in claim 1, wherein the first contact portion has a first convex portion bent downward and the second contact portion has a second convex portion bent upward, so the combination of the first convex portion and the second convex portion can hold the printed circuit board.

3. An input/output connector as claimed in claim 1, wherein the connector body has a slot for receiving the printed circuit board.

4. An input/output connector as claimed in claim 1, wherein the connector body is provided with a bulge for abutting against the shell.

5. An input/output connector as claimed in claim 1, wherein the first and the second engaging portions are partially exposed to the outside of the shell, so as to allow the printed circuit board to form an electrically conductive contact with an external electric device through the first and the second engaging portions.

6. An input/output connector as claimed in claim 1, wherein a space is formed between the first terminal and the first bottom surface such that neither the first contact portion nor the first engaging portion come in contact with the first bottom surface, so that the first terminal can bend upwardly for a predetermined distance without engaging with the first bottom surface.

7. An input/output connector as claimed in claim 1, wherein the engaging blocks and the connector body are integral with each other.

* * * * *